US008480293B2

(12) United States Patent
Colpo

(10) Patent No.: US 8,480,293 B2
(45) Date of Patent: Jul. 9, 2013

(54) TIMEPIECE

(75) Inventor: Fabiano Colpo, Lausanne (CH)

(73) Assignee: Rolex S.A., Geneva (CH)

( * ) Notice: Subject to any disclaimer, the term of this patent is extended or adjusted under 35 U.S.C. 154(b) by 103 days.

(21) Appl. No.: 13/179,059

(22) Filed: Jul. 8, 2011

(65) Prior Publication Data

US 2012/0014228 A1 Jan. 19, 2012

(30) Foreign Application Priority Data

Jul. 15, 2010 (EP) ..... 10405138

(51) Int. Cl.
*G04B 15/00* (2006.01)

(52) U.S. Cl.
USPC ..... 368/129; 368/125

(58) Field of Classification Search
USPC ..... 368/124–125, 129–131
See application file for complete search history.

(56) References Cited

U.S. PATENT DOCUMENTS 220,763 A * 10/1879 Johnston ..... 368/131
1,105,062 A * 7/1914 Cochran ..... 368/131
1,359,005 A * 11/1920 Verner ..... 368/132
3,678,683 A * 7/1972 Cielaszyk ..... 368/133
7,553,068 B2 * 6/2009 Cabezas Jurin et al. ..... 368/132
2010/0182879 A1 * 7/2010 Conus et al. ..... 368/131

FOREIGN PATENT DOCUMENTS

EP 1122617 A1 8/2001
FR 567914 A 3/1924

OTHER PUBLICATIONS

European Search Report of EP 10 40 5138, date of mailing Jan. 7, 2011.

* cited by examiner

*Primary Examiner* — Sean Kayes
(74) *Attorney, Agent, or Firm* — Westerman, Hattori, Daniels & Adrian, LLP

(57) ABSTRACT

This timepiece is furnished with a direct impulse escapement comprising a locking lever (2) for locking the escapement wheel furnished with two locking pallets (2*a*, 2*b*), with a fork (2*c*) and with a guard pin (2*d*). The guard pin is mounted so as to pivot on the fork about an axis parallel to the pivoting axis of the locking lever (2). It comprises displacement means ($\mathbf{2}d_1$, $\mathbf{2}d_2$, $\mathbf{2}d_3$), designed to engage with drive means secured to said frame, so as to amplify the angular displacement of the guard pin (2*d*), caused by the locking lever (2) passing from one to the other of its two positions. This invention also applies to the guard pin of a pallet assembly of an indirect impulse escapement.

20 Claims, 4 Drawing Sheets

TIMEPIECE

The present invention relates to a timepiece furnished with a direct impulse escapement, comprising a frame on which are pivotingly mounted an escapement wheel, a locking lever for locking the escapement wheel furnished with two locking pallets, with a fork and with a guard pin, a spiral-balance oscillator furnished with a double roller supporting an impulse pallet, a disengagement pin and a detent for allowing the guard pin to pass; the impulse pallet being positioned in order to intersect the trajectory of the teeth of the escapement wheel, the disengagement pin being positioned in order to engage with the fork on each half-period of oscillation of the balance in order to release the locking lever in order to allow it to tilt between two positions for locking the teeth of the escapement wheel and allow force to be transmitted from a tooth of the escapement wheel to the impulse pallet on each period of oscillation of the balance. The present invention also relates to a timepiece furnished with an indirect impulse escapement based on the same inventive concept.

The fixed guard pin routinely used in the case of all Swiss pallet assembly escapements effectively fulfils the function of preventing the pallet assembly from turning over in the event of impact for which it has been designed. Moreover it is by virtue of the guard pin that the Swiss pallet assembly escapement owes its success to a large extent, it being, because of its safety, the escapement used in virtually all wrist watches.

Unfortunately, while favoring the Swiss pallet assembly, the guard pin has greatly disadvantaged the majority of the other escapement systems, mainly because of the geometric and/or operating constraints of construction (dimensioning) that characterize these systems. The only way of using the guard pin with other types of escapement and in particular direct impulse escapements (such as the Robin escapement) is to increase the angle of tilt of the locking lever, which causes a reduction in efficiency such that it practically cancels out the advantages of these escapements.

The Robin escapement is an escapement which combines the advantages of the detent escapement (high efficiency and direct transmission of energy between the escapement wheel and the balance) with those of the pallet assembly escapement (better operating safety). It is therefore a direct impulse escapement that uses a locking lever furnished with two stop pallets and which tilts between two extreme stop positions. Unlike the Swiss pallet assembly escapement, the impulse is transmitted directly by the escapement wheel to the balance and the lever is used only to stop the escapement wheel outside the impulse phases.

The incorporation of a Robin escapement in a wrist watch is made difficult by being impossible to effectively use a fixed guard pin. The guard pin, which is usually a fixed part countersunk close to the fork of the locking lever prevents, in combination with the small detented roller of the double roller secured to the balance, the locking lever from turning over when there is an impact. Specifically, there is no spring that holds the locking lever in its stop position as is the case for a detent escapement. Such a turning over has catastrophic consequences on the operation of the watch, because the unintended release of the locking lever will place it in its second extreme position from which it can no longer be released by the pin secured to the balance, which has the result of stopping the watch. The dimensioning and the use of a guard pin imposes a tilt angle of the locking lever comparable with that of the Swiss pallet assembly (typically 15°), while it is typically 3-4° for a current Robin escapement.

It has already been mentioned that a tilt angle of 15° would greatly limit the efficiency of the Robin escapement and would make it lose the essence of its value. A solution is clearly to find another way for securing the escapement against impacts, but no system as simple and effective as a guard pin has been proposed to our knowledge.

The object of the present invention is to provide a solution for preventing the overturning of a locking lever or of a pallet assembly when their tilt angle is very low, typically less than 5°, as is the case of the locking lever of a direct impulse escapement such as the Robin escapement in particular, but since that could also be the case with indirect impulse escapements, such as the Swiss pallet assembly escapement in a particular configuration, in which the pallet assembly has a tilt angle considerably less than that of the usual pallet assembly.

Accordingly, the subject of this invention is a timepiece furnished with a direct impulse escapement as claimed in claim 1, and a time piece furnished with an indirect impulse escapement as claimed in claim 2, based on the same inventive concept.

The guard pin mounted so as to pivot according to the invention makes it possible to amplify its angular displacement without modifying the angular displacement of the locking lever or of the pallet assembly, which increases safety against the overturn even when the tilt angle of the locking lever or of the pallet assembly itself is very slight, typically less than 5°. The solution that makes it possible to solve the problem posed is also of very simple design which ensures reliability.

The appended drawings illustrate, schematically and as an example, two forms of execution and a range of variants of the escapement of the timepiece that is the subject of the present invention.

Figure 1:
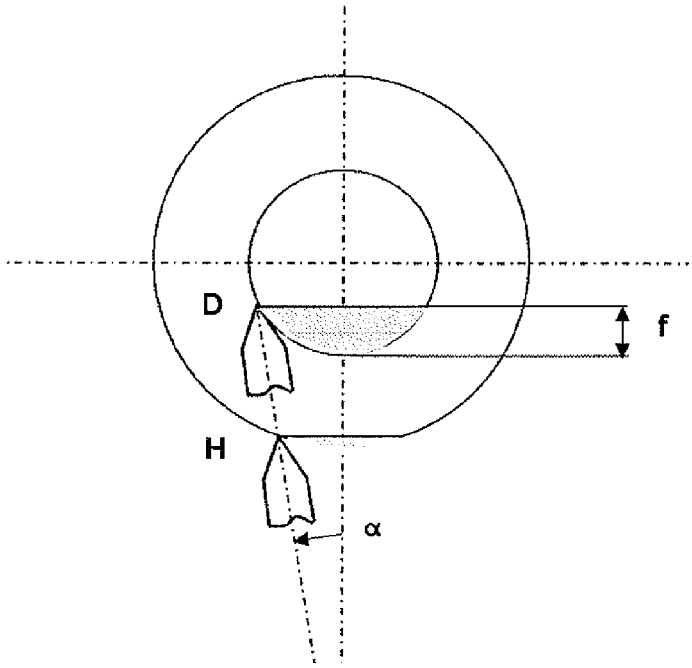
FIG. 1 is a plan view illustrating the operating principle of a fixed guard pin according to the prior art.

FIG. 1 is drawn from the work entitled "Les échappements" ("The escapements") (C. Huguenin, S. Guye, M. Gauchat, Technicum Neuchâtelois, Le Locle, 1965) and illustrates the effectiveness of the guard pin depending on the diameter of the small roller secured to the arbor of the balance.

As can be deduced from FIG. 1, the safety that the guard pin provides increases inversely to the radius of the small balance roller. Specifically it is possible to notice that the deflection f of the chord, the ends of which correspond to the points of contact of the guard pin with the roller, increases when the diameter of the roller reduces for a given angle of tilt $\alpha$. The position H is therefore the least favorable, because the more the guard pin comes into contact with the small roller close to the line of the centers, the more the risk of bracing increases.

When the guard pin is designed, one of the first parameters to be set is the value of the deflection f that must be correctly determined according to the dimensions of the parts, to the manufacturing technique, and/or to the tolerances. For a given length of guard pin and corresponding to the point D in FIG. 1 and standard dimensions for the pallet assembly and the small roller of the balance, the only way of preventing friction between the guard pin and this same roller is to have a considerable total tilt angle ($\alpha$) of the pallet assembly, typically 16°. This value is perfectly compatible with the operation/dimensions of the Swiss pallet assembly escapement.

On the other hand, it is no longer the same in the case of the Robin escapement. The Robin escapement is characterized in that its locking lever has a tilt angle that is between 4 and 5 times smaller than that of a Swiss pallet assembly. In fact, since the force is transmitted directly from the teeth of the escapement wheel to the pallets of the balance (more compact system) and the pallets of the locking lever transmit no force but are used only to alternately lock the teeth of the escapement wheel, the distances (angles) to be traveled for the clearance of the wheel are substantially reduced. This small tilt angle therefore represents a certain advantage from the point of view of effectiveness of the escapement and of the isochronism of the spiral-balance oscillator but, at the same time, makes a fixed guard pin practically unusable. Specifically, because of the small tilt angle ($\approx\alpha/4$), a guard pin with a length D would come into contact with the small roller which makes it necessary to reduce its length, hence the deflection f and finally the safety of the escapement in the case of impacts. Consequently, the use of a fixed guard pin to safeguard a Robin escapement is made very difficult because of the manufacturing tolerances of the components of the escapement and of their pivoting clearances.

To solve this problem, the present invention proposes to separate the tilt of the locking lever from the tilt of the guard pin by making the latter pivot about an axis secured to the locking lever and parallel to the pivoting axis of the locking lever.

The idea behind the pivoting guard pin arises from the need to have a considerable tilt angle in order to obtain correct operation of the guard pin while keeping the small tilt angle of the lever of the Robin escapement. The only way of achieving this objective is to mount the pivoting guard pin by creating a kinematic connection between the pivoting of the guard pin and the tilt of the locking lever. Accordingly, the guard pin comprises displacement means preferably situated at a distance s from its pivoting axis that is smaller than the distance r between these displacement means and the pivoting axis of the locking lever, these distances being measured in one of the extreme positions of the lever, and formed so as to engage with drive means secured to the frame of the timepiece. This arrangement makes it possible to amplify the angular displacement of the guard pin, caused by the movement of the locking lever from one to the other of its two positions.

Such a solution will therefore give a locking lever with a tilt angle of approximately 2°-4° of amplitude while the guard pin will tilt through an angle of 12°-19°, sufficiently large to ensure good safety against the overturning of the locking lever. The angle values indicated above will of course depend on the construction and are therefore given as an indication.

Figure 3:
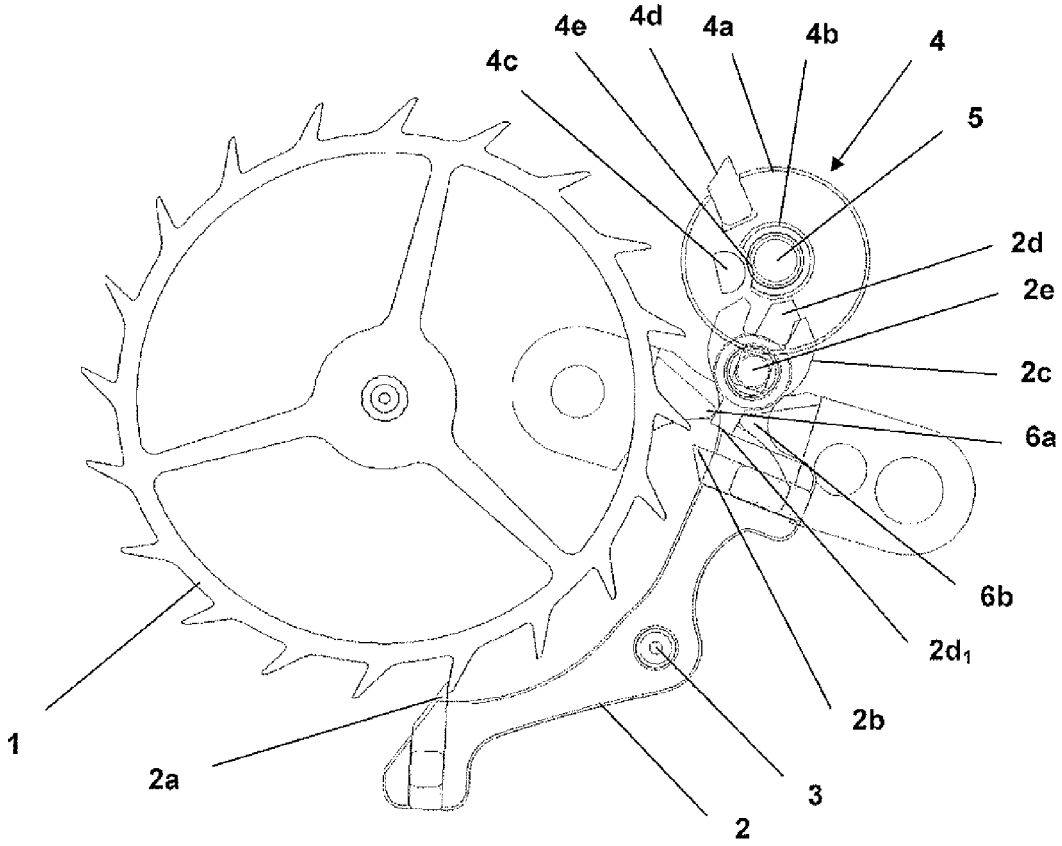
FIG. 3 is a plan view of a first form of execution applied to a direct impulse escapement.

The solution produced and tested is illustrated by FIG. 3 in which a Robin escapement has been shown mounted on the frame (not shown) of a timepiece. This escapement comprises an escapement wheel 1, a locking lever 2 of the escapement wheel 1, mounted so as to pivot about a pivoting axis 3 on the frame of the timepiece and a double roller 4 secured to a pivoting arbor 5 of a spiral-balance oscillator (not shown).

The locking lever 2 comprises two locking pallets 2*a*, 2*b* designed to alternately penetrate the trajectory of the teeth of the escapement wheel 1, a fork 2*c* designed to work with a pin 4*c* secured to the largest roller 4*a* of the double roller 4. A guard pin 2*d* is mounted so as to pivot on the fork 2*c* of the locking lever 2, about a pivoting tenon 2*e* with an axis parallel to the pivoting axis 3 of this lever 2. The guard pin comprises a tail $\mathbf{2}d_1$, forming the means of displacement of the guard pin and mounted between two limiting abutments 6*a*, 6*b*, forming the drive means of the guard pin 2*d*.

The double roller 4, secured to the pivoting arbor 5 of the balance, also supports an impulse pallet 4*d* which receives directly an impulse from a tooth of the escapement wheel once per oscillation period of the balance. The small roller 4*b* of the double roller 4 has, as usual, a detent 4*e* radially inline with the pin 4*c* in order to allow the guard pin to pass when the locking lever 2 is driven by the pin 4*c* being engaged between the prongs of the fork 2*c*.

Figure 2:
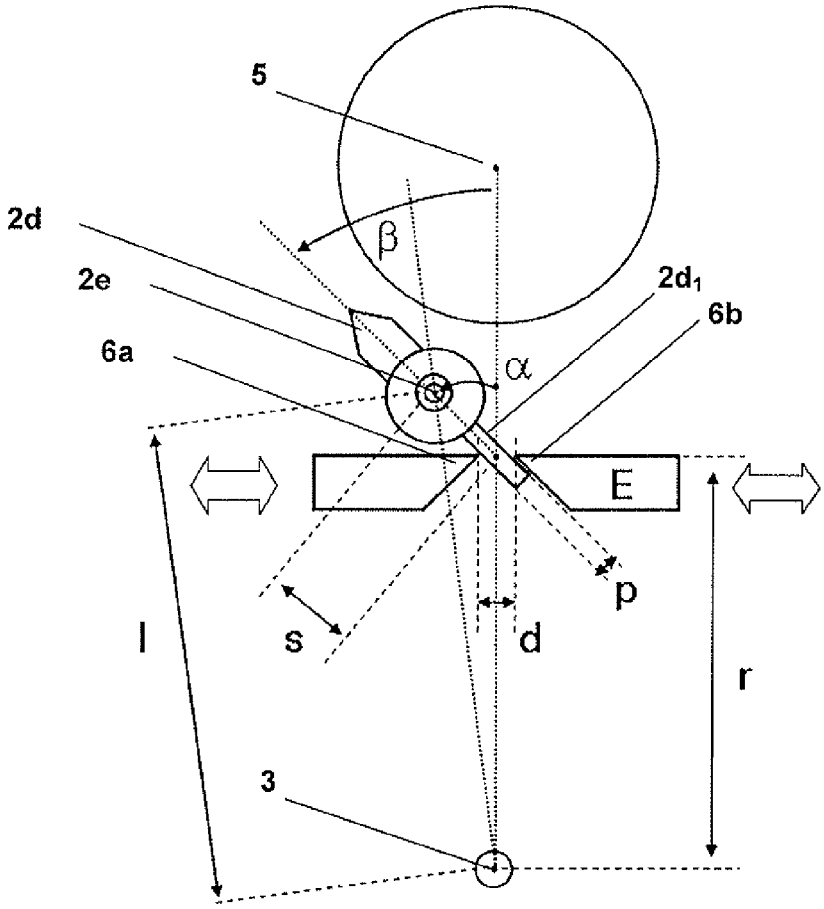
FIG. 2 is a plan view illustrating the operating principle of a pivoting guard pin according to the invention.

The dimensioning of the pivoting guard pin 2*d* is particularly simple and a single trigonometric relationship is sufficient to determine all the parameters that are required. To clearly understand the formula, reference should be made to FIG. 2 which represents the main geometric parameters of the escapement with a moveable guard pin in one of the extreme positions of the locking lever.

β corresponds to the tilt angle of the pivoting guard pin 2*d* relative to the line of the centers that connects the pivoting center 3 of the locking lever 2 to the pivoting center 5 of the balance. α corresponds to the tilt angle of the locking lever (and to the tilt angle of the guard pin when the latter is fixed) relative to this same line of the centers. The cosine theorem allows us to write the following relation:

$$l^2=s^2+r^2+2\cdot sr\cdot\cos(\beta) \tag{1}$$

That can be resolved for the distance (r):

$$r=\frac{-2\cdot s\cdot\cos(\beta)\pm\sqrt{(2\cdot s\cdot\cos(\beta))^2-4\cdot(s^2-l^2)}}{2} \tag{2}$$

Depending on the angle β necessary for the correct operation of the pivoting guard pin 2*d* and on the length l between the pivoting point of the guard pin 2*e* and the pivoting point of the lever 3, it is possible to determine the position r of the limitation abutments 6*a*, 6*b* on the line of the centers. In particular, s represents the distance between the pivoting point of the guard pin and the point of intersection between the line of the wheel-balance centers and the tail of the guard pin measured in one of the extreme positions of the lever. The distances l and s are also connected by the relationship $l/\sin(\beta)=s/\sin(\alpha)$. It should also be noted that, for a given tilt angle β, the spacing d of the abutments 6*a*, 6*b* depends only on the width p of the tail $\mathbf{2}d_1$ of the guard pin 2*d*.

In order to test the movable guard pin, an implementation similar to that illustrated in FIG. 3 has been set up on a test fitting comprising a spiral-balance oscillator, a Robin escapement, a gear train and a barrel in order to simulate conditions close to use in a clockwork movement. The guard pin 2*d* and the limitation abutments 6*a*, 6*b* have been made in Ni using LIGA technology. The pivoting tenon of the guard pin was made in 20AP steel.

For a first evaluation of the effect of the moveable guard pin, we compared the amplitudes of the balance in different positions before and after installing the moveable guard pin. The first results are shown below according to the number of winding revolutions of the barrel. The amplitudes are the averages of the two horizontal positions and of the four vertical positions respectively.

| | Amplitude at 3 winding revolutions [°] | Amplitude at 6 winding revolutions [°] | Amplitude at 12 winding revolutions [°] |
|---|---|---|---|
| Without movable guard pin | | | |
| Horizontal position | 232 | 270 | 282 |
| Vertical position | 201 | 233 | 252 |
| With movable guard pin | | | |
| Horizontal position | 232 | 264 | 275 |
| Vertical position | 201 | 229 | 243 |

The losses due to the presence of the movable guard pin are slight, less than 10° on complete winding (12 revolutions), and reduce with the degree of winding of the barrel. The effect of the movable guard pin reduces therefore with the amplitude, which is ideal because it is at low amplitudes of oscillation that a loss of amplitude is critical for the working of the movement. We also noticed a slight difference in the amplitudes between the various vertical positions. No stoppage occurred and the test fittings rotate without problem with an autonomy of approximately 3 days. As is the case with a movement with Swiss pallet-assembly escapement furnished with the same barrel and with the same oscillator.

At this stage, the surface states of the prototype parts are not optimal, the material pairs are not optimized, no lubrication has been used and certain dimensions were slightly out of tolerance. Despite this, no overturning of the locking lever was found, even after several severe impacts. The results therefore show that the escapement with pivoting guard pin operates satisfactorily.

Certain modifications can yet be made to improve the behavior of the pivoting guard pin. Amongst them it is possible to mention the improvement of the pivoting of the guard pin in order to reduce the friction. It is possible to envisage using a liquid lubrication, a tribological coating with low coefficient of friction or using a ruby bearing countersunk into or bonding onto the moveable guard pin installed so as to pivot on the pivoting tenon secured to the fork.

Another possibility that can be envisaged would be to produce the guard pin by causing Ni to grow by the LIGA method around a ruby bearing. This manufacturing method would make it possible to prevent the problems of bonding or of countersinking the bearing.

Other evaluations of the effect of the moveable guard pin have been carried out and have shown that the first test related above represents a particularly unfavorable situation. Subsequent tests have not made it possible to demonstrate an effect of the moveable guard pin on the amplitude, in particular by virtue of a careful adjustment of the shakes.

Figure 4:
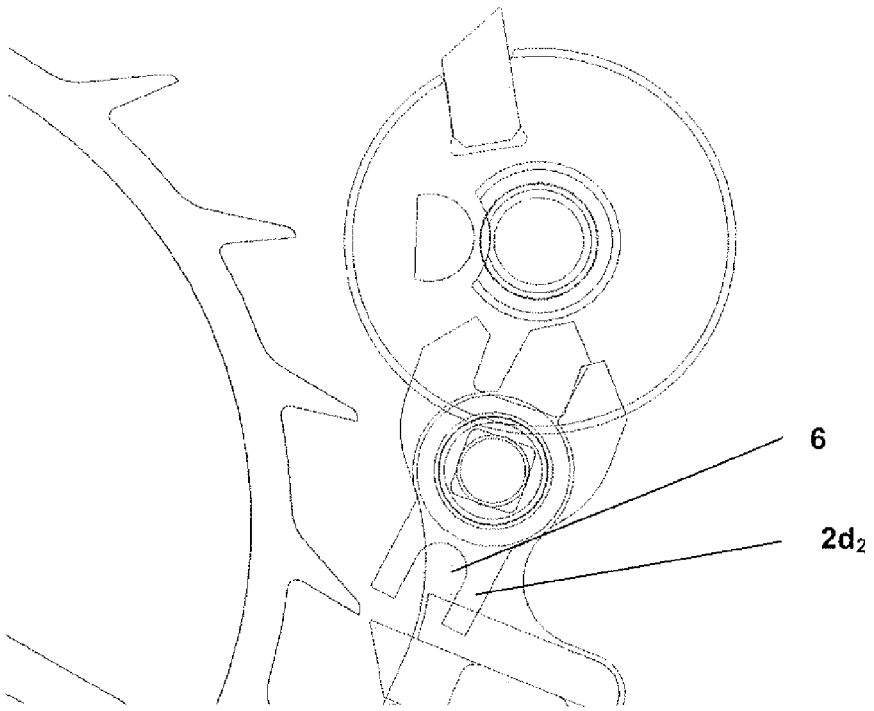
FIGS. 4 and 5 are plan views of two variants of FIG. 3.

FIG. 4 illustrates a variant of FIG. 3 in which the tail of the guard pin is made in the form of a fork $\mathbf{2}d_2$, the abutments 6*a*, 6*b* being replaced by a fixed cotter 6 engaged between the prongs of the fork $\mathbf{2}d_2$. The position of this cotter 6 can be adjustable, for example by associating the cotter 6 with an eccentric, in order to make it possible to modify the tilt angle of the guard pin. Such a solution would reduce the space requirement relative to the abutments 6*a*, 6*b*.

For the purpose of reducing friction and of retaining the possibility of fine adjustment of the tilt angle of the guard pin 2*d*, it is possible to use abutments 6*a*, 6*b* made of ruby in escapement-pallet form. These pallets could be installed in sliders making it possible to carry out a simple and distinct adjustment of the two abutments 6*a*, 6*b*, as shown by the double arrows in FIG. 2, in order to make it easier to adjust the escapement and correct possible manufacturing defects.

Figure 5:
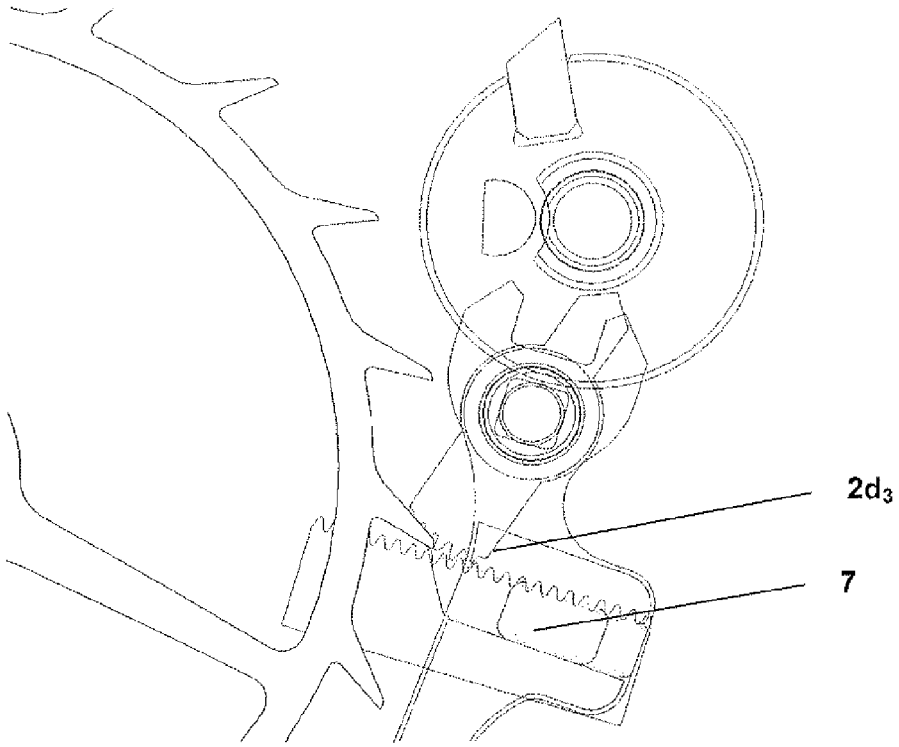

FIG. 5 illustrates a second variant of FIG. 3, in which the tail $\mathbf{2}d_3$ of the guard pin 2*d* comprises a tooth engaged with a rack 7 secured to the frame of the timepiece. The effect is the same as that of the abutments.

Figure 6:
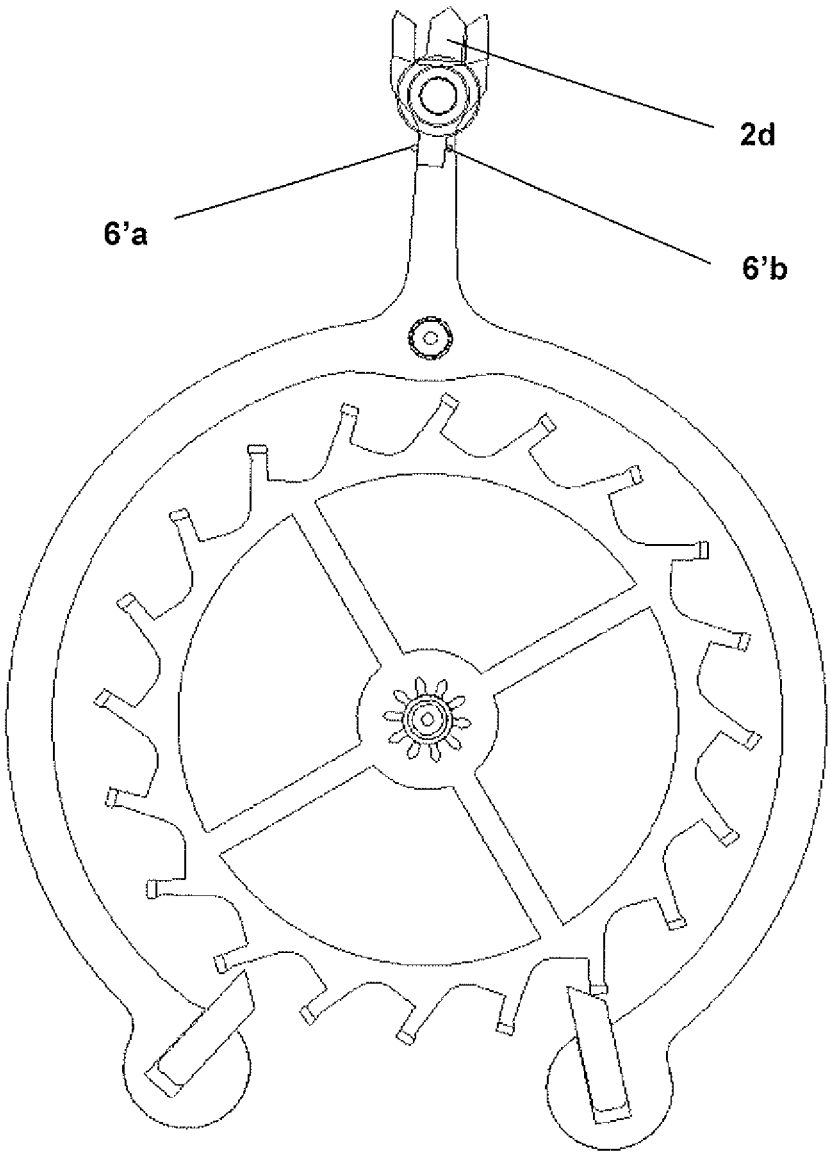
FIG. 6 is a plan view of a second form of execution applied to an indirect impulse escapement.

The form of execution illustrated by FIG. 6 relates to an indirect impulse escapement of the Swiss pallet assembly escapement type. The tilt of the guard pin 2*d* is ensured by two cotters 6'*a*, 6'*b* secured to the frame. In the example illustrated, the tilt angle of the pallet assembly is 6°, that is substantially less than in a conventional Swiss pallet assembly escapement. By virtue of the pivoting guard pin system 2*d*, the tilt angle of the guard pin is 15°. The angles are calculated relative to the wheel-balance center line.

The invention claimed is:

1. A timepiece furnished with a direct impulse escapement comprising a frame on which are pivotingly mounted an escapement wheel, a locking lever for locking the escapement wheel furnished with two locking pallets, with a fork and with a guard pin, a spiral-balance oscillator furnished with a double roller supporting an impulse pallet, a disengagement pin and a detent for allowing the guard pin to pass; the impulse pallet being positioned in order to intersect the trajectory of the teeth of the escapement wheel, the disengagement pin being positioned in order to engage with the fork on each half-period of oscillation of the balance in order to release the locking lever in order to allow the locking lever to tilt between two positions for locking the teeth of the escapement wheel and allow force to be transmitted from a tooth of the escapement wheel to the impulse pallet on each period of oscillation of the balance, wherein the guard pin is mounted so as to pivot on the fork about an axis parallel to the pivoting axis of the locking lever and wherein the guard pin comprises displacement means, designed to engage with drive means secured to said frame, so as to amplify the angular displacement of the guard pin caused by the locking lever passing from one to the other of the two positions for locking the teeth of the escapement wheel.

2. The timepiece as claimed in claim 1, wherein said displacement means are situated at a lesser distance from the pivoting axis of said guard pin than the distance between these displacement means and the pivoting axis of said locking lever, and of said pallet assembly respectively, measured in one of their extreme positions.

3. The timepiece as claimed in claim 2, wherein the guard pin is mounted so as to pivot by means of a ruby bearing.

4. The timepiece as claimed in claim 2, wherein the driving means secured to the frame comprise two abutments, each mounted adjustably.

5. The timepiece as claimed in claim 2, wherein the guard pin is secured to a toothed sector in engagement with a rack secured to the frame.

6. The timepiece as claimed in claim 1, wherein the guard pin is mounted so as to pivot by means of a ruby bearing.

7. The timepiece as claimed in claim 6, wherein the driving means secured to the frame comprise two abutments, each mounted adjustably.

8. The timepiece as claimed in claim 6, wherein the guard pin is secured to a toothed sector in engagement with a rack secured to the frame.

9. The timepiece as claimed in claim 1, wherein the driving means secured to the frame comprise two abutments, each mounted adjustably.

10. The timepiece as claimed in claim 1, wherein the guard pin is secured to a toothed sector in engagement with a rack secured to the frame.

11. The timepiece as claimed in claim 1, wherein said displacement means for displacing the guard pin comprise a fork between the prongs of which a pin is engaged secured to the frame.

12. The timepiece as claimed in claim 11, wherein said pin is associated with means for adjusting the position of said pin.

13. A timepiece furnished with an indirect impulse escapement, comprising a frame on which are mounted pivotingly an escapement wheel, a pallet assembly furnished with two pallets, a fork and a guard pin, a spiral-balance oscillator furnished with a double roller supporting a disengagement pin and a detent for allowing the guard pin to pass; the disengagement pin being positioned so as to engage with the fork on each half-period of oscillation of the balance, in order to displace the pallet assembly between two positions for locking the teeth of the escapement wheel, wherein the guard pin is mounted pivotingly on the fork about an axis parallel with the pivoting axis of the pallet assembly and wherein the guard pin comprises displacement means, designed to engage with driving means secured to said frame, so as to amplify the angular displacement of the guard pin caused by the pallet assembly passing from one to the other of the two positions for locking the teeth of the escapement wheel.

14. The timepiece as claimed in claim 13, wherein said displacement means are situated at a lesser distance from the pivoting axis of said guard pin than the distance between these displacement means and the pivoting axis of said locking lever, and of said pallet assembly respectively, measured in one of their extreme positions.

15. The timepiece as claimed in claim 14, wherein the guard pin is mounted so as to pivot by means of a ruby bearing.

16. The timepiece as claimed in claim 13, wherein the guard pin is mounted so as to pivot by means of a ruby bearing.

17. The timepiece as claimed in claim 13, wherein the driving means secured to the frame comprise two abutments, each mounted adjustably.

18. The timepiece as claimed in claim 13, wherein the guard pin is secured to a toothed sector in engagement with a rack secured to the frame.

19. The timepiece as claimed in claim 13, wherein said displacement means for displacing the guard pin comprise a fork between the prongs of which a pin is engaged secured to the frame.

20. The timepiece as claimed in claim 19, wherein said pin is associated with means for adjusting the position of said pin.

* * * * *